US010461486B2

(12) United States Patent
Kashimoto

(10) Patent No.: US 10,461,486 B2
(45) Date of Patent: Oct. 29, 2019

(54) DIE AND PRESS APPARATUS INCLUDING DIE

(71) Applicant: JAPAN AVIATION ELECTRONICS INDUSTRY, LIMITED, Shibuyaku, Tokyo (JP)

(72) Inventor: Yoshihisa Kashimoto, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 54 days.

(21) Appl. No.: 15/285,041

(22) Filed: Oct. 4, 2016

(65) Prior Publication Data

US 2017/0133808 A1 May 11, 2017

(30) Foreign Application Priority Data

Nov. 5, 2015 (JP) ..... 2015-217437

(51) Int. Cl.
*H01R 43/048* (2006.01)
*H01R 43/058* (2006.01)

(52) U.S. Cl.
CPC ..... *H01R 43/048* (2013.01); *H01R 43/058* (2013.01); *Y10T 29/49181* (2015.01); *Y10T 29/49185* (2015.01); *Y10T 29/5148* (2015.01); *Y10T 29/53235* (2015.01)

(58) Field of Classification Search
CPC .. H01R 43/04; H01R 43/048; H01R 43/0482; H01R 43/059; Y10T 29/49181; Y10T 29/49183; Y10T 29/49185; Y10T 29/5148; Y10T 29/5149; Y10T 29/53213; Y10T 29/53235; Y10T 29/5327; Y10S 72/712
See application file for complete search history.

(56) References Cited

U.S. PATENT DOCUMENTS 4,261,194 A * 4/1981 Stephens ..... H01R 43/042 72/402
4,272,879 A * 6/1981 Wigby ..... H01R 43/04 29/566.2
4,991,289 A * 2/1991 French ..... H01R 43/058 29/519
5,671,528 A 9/1997 Endo et al.
5,901,439 A 5/1999 Endo et al.
6,067,828 A 5/2000 Bucher et al.
(Continued)

FOREIGN PATENT DOCUMENTS

CN 1317855 A 10/2001
CN 201562869 U 8/2010
(Continued)

OTHER PUBLICATIONS

Chinese Office Action dated Feb. 22, 2019 (and English translation thereof) issued in counterpart Chinese Application No. 201610863901.2.

(Continued)

*Primary Examiner* — Peter Dungba Vo
*Assistant Examiner* — Joshua D Anderson
(74) *Attorney, Agent, or Firm* — Holtz, Holtz & Volek PC

(57) ABSTRACT

A die extended in the service life. An anvil includes a base portion and a protruding portion, and further, includes a wall portion that is connected to rear surfaces of the base portion and the protruding portion. The wall portion extends further upward than the base portion, and extends further leftward and rightward than the protruding portion. Therefore, the rigidity of the protruding portion in a left-right direction is high.

10 Claims, 9 Drawing Sheets

(56) References Cited

U.S. PATENT DOCUMENTS

| | | | | |
|---|---|---|---|---|
| 6,530,257 | B2 | 3/2003 | Ooji et al. | |
| 7,764,044 | B2 | 7/2010 | Ishikawa et al. | |
| 2001/0035039 | A1 | 11/2001 | Ooji et al. | |
| 2004/0007042 | A1* | 1/2004 | Imgrut | H01R 43/055 72/412 |
| 2008/0067973 | A1 | 3/2008 | Ishikawa et al. | |
| 2012/0124826 | A1* | 5/2012 | Onuma | H01R 43/0486 29/753 |
| 2015/0325969 | A1* | 11/2015 | Belovarac | H01R 43/055 29/833 |

FOREIGN PATENT DOCUMENTS

| | | | |
|---|---|---|---|
| CN | 201690106 | U | 12/2010 |
| CN | 202772402 | U | 3/2013 |
| EP | 1780864 | A1 | 5/2007 |
| JP | H06031098 | U | 4/1994 |
| JP | H08222343 | A | 8/1996 |
| JP | 09115639 | A | 5/1997 |

OTHER PUBLICATIONS

Chinese Office Action dated Jun. 27, 2018 (and English translation thereof) issued in counterpart Chinese Application No. 201610863901.2.

Japanese Office Action dated Apr. 24, 2019 (and English translation thereof) issued in Japanese Application No. 2015-217437.

Chinese Office Action dated Aug. 5, 2019 (and English translation thereof) issued in counterpart Chinese Application No. 201610863901.2.

* cited by examiner

DIE AND PRESS APPARATUS INCLUDING DIE

BACKGROUND OF THE INVENTION

Field of the Invention

This invention relates to a die and a press apparatus including the die.

Description of the Related Art

Conventionally, as shows in FIGS. 8 and 9, there has been known a terminal crimping machine 901 for crimping a terminal 922 on as electric wire (not shows) (see Japanese Laid-Open Patent Publication (Kokai) No. H09-115639). Japanese Laid-Open Patent Publication (Kokai) No. H09-115639 gives the following description.

The terminal crimping machine 901 includes crimpers 932 which are upper dies lifted up and down, and anvils 902 which are lower dies.

Each anvil 902 has a protruding portion 902A which protrudes upward. A conductor crimping piece portion 923 and a sheath crissping piece portion 924 of the terminal 922 are supported on respective upper surfaces of elongated protruding portions 902A.

The crimpers 932 have a receiving space 932A for receiving the protruding portions 902A of the anvils 902.

Before the terminal 922 is crimped on the electric wire, the anvils 902 are arranged below the crisipers 932, and then the crimpers 932 are lowered. At this time, the protruding portions 902A of the anvils 902 are relatively inserted into the receiving space 932A of the crimpers 932. The conductor crimping piece portion 923 and the sheath crimping piece portion 924 of the terminal 922, which are supported on the upper surfaces of the protruding portions 902A of the anvils 902, are deformed by being sandwiched between the upper surfaces of the protruding portions 902A of the anvils 902 and inner wall surfaces (surfaces facing the receiving space 932A) of the crimpers 932, whereby the conductor crimping piece portion 923 of the terminal 922 is crimped on a conductor portion, (not shown) of the electric wires and the sheath existing piece portion 924 of the terminal 922 is crimped on a sheath (not shown) of the electric wire.

When the number of times of use of the anvils 902 is small, even if the protruding portion 902A of each anvil 902 is tilted by impact applied when the terminal 922 is crimped on the electric wire, the protruding portion 902A returns to the original state thereof again.

However, if the number of times of use of the anvils 902 increases, the tilted protruding portion 902A does not return to the original state thereof due to the structure of the anvil 902, which prevents the terminal 922 from being correctly crimped on the electric wire.

Therefore, the anvils 902 may be required to be replaced by new anvils 902 in relatively early time after starting the use of the anvil 902.

SUMMARY OF THE INVENTION

The present invention has been made in view of these circumstances, and an object thereof is to extend the service life of a die.

To attain the ahove object, in a first aspect of the present inventions there is provided a die that crimps a contact in cooperation with a seating die to thereby fix the contact on an electric wire, comprising a base portion, a protruding, portion that is formed on the base portion in a manner protruding upward from the base portion, and can be inserted in a receiving space of the mating die, and a wall portion that is connected to front surfaces, rear surfaces, or front and rear surfaces of the base portion and the protruding portion, wherein the wall portion extends further upward than the base portion, and extends further in at least one of leftward, and rightward directions than the protruding portion.

Preferably, the wall portion is plate-shaped

Preferably, an upper surface of the protruding portion, on which the contact is supported, is formed with a dent, the wall portion is formed with a flat surface that is located at a level lower than the upper surface of the protruding portion, and is adjacent to the upper surface in a front-rear direction of the protruding portion, and one end of the flat surface in the front-rear direction is formed with a cutting blade for cutting a supporting arm portion of a carrier that supports the contact.

More preferably, a dimension of the flat surface of the wall portion in a left-right direction of the protruding portion is larger than a dimension of the upper surface of the protruding portion in the left-right direction.

More preferably, the wall portion has inclined surfaces formed in a manner continuous with the flat surface such that the inclined surfaces are inclined downward from the flat surface as the inclined surfaces extend away from the fiat surface in the left-right direction.

To attain the above object, in a second aspect of the present invention, there is provided a press apparatus including a die described in the first aspect of the present invention.

According to the present invention, it is possible to extend the service life of the die.

The above and other objects, features and advantages of the present invention will become more apparent from the following detailed description taken in conjunction with the accompanying drawings.

DETAILED DESCRIPTION OF THE PREFERRED EMBODIMENT

The present invention will now be described in detail with reference to the drawings showing preferred embodiments thereof.

Figure 1:
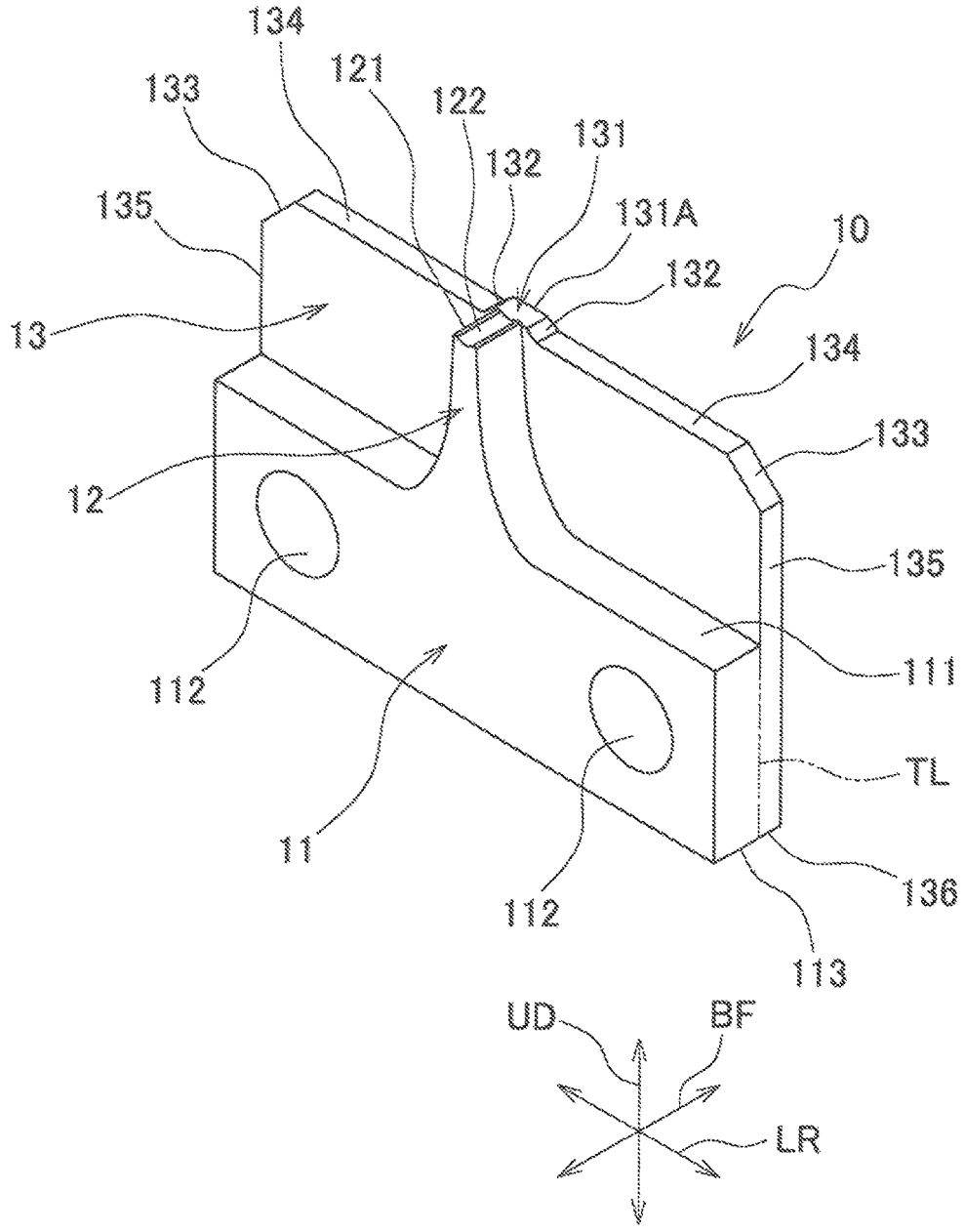
FIG. 1 is a perspective view of an anvil according to a first embodiment of the present invention.
Figure 2:
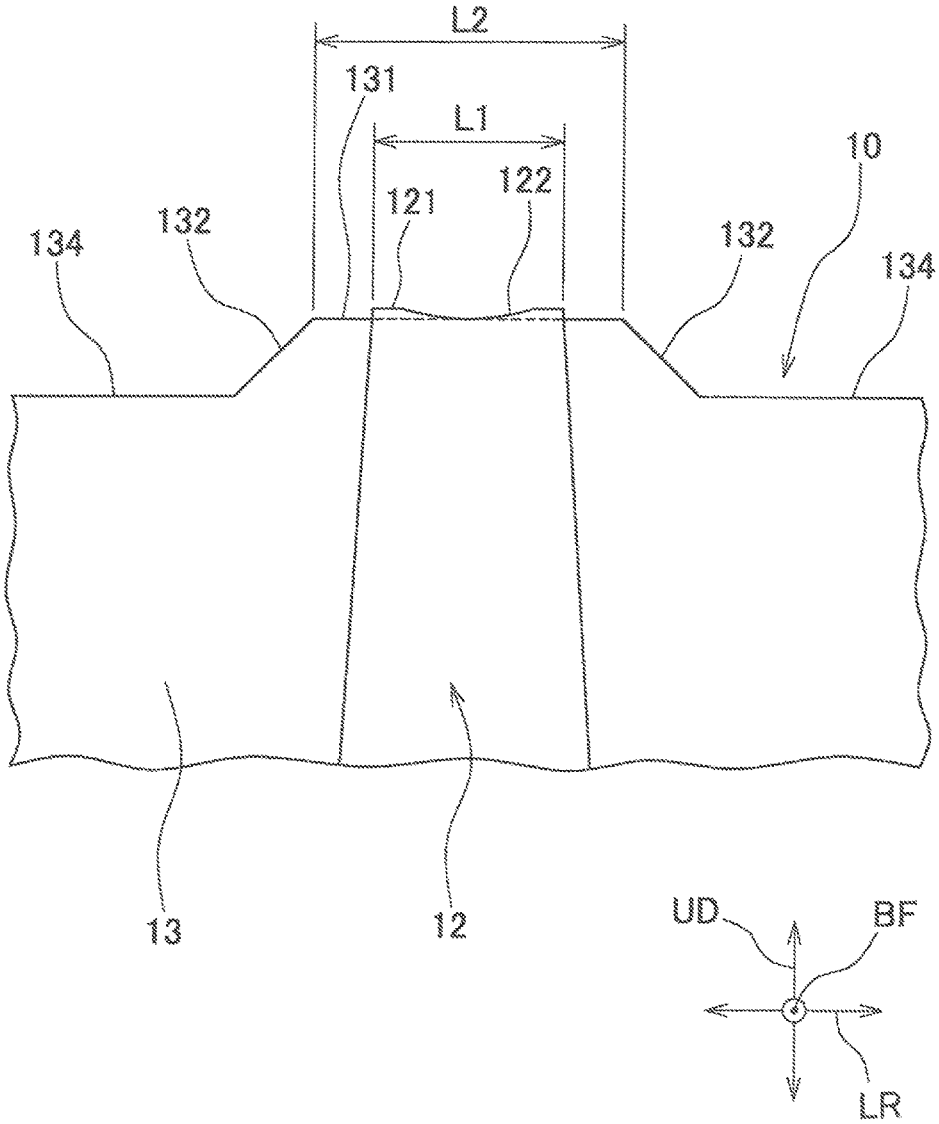
FIG. 2 is an enlarged partial front view of the anvil shown in FIG. 1.
Figure 3:
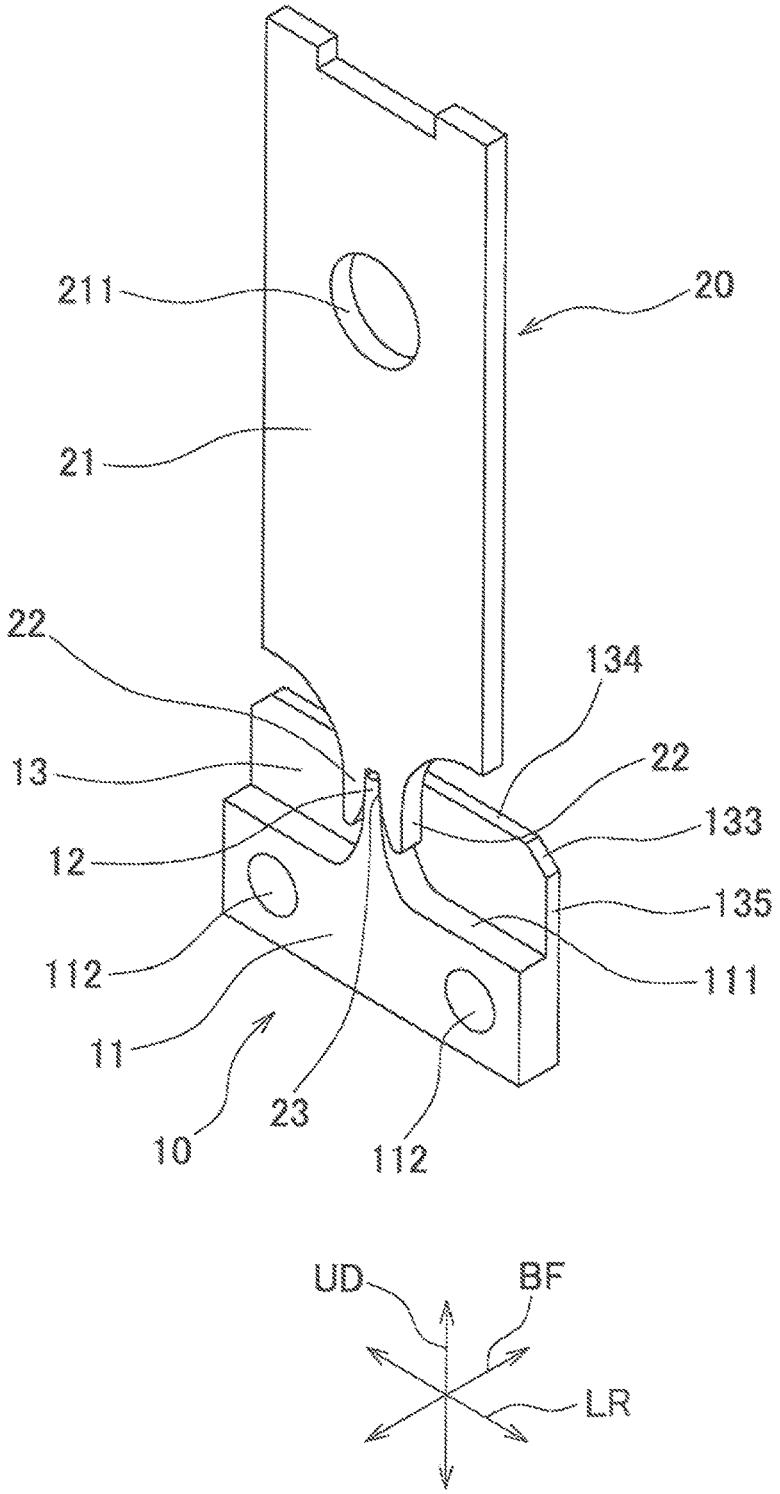
FIG. 3 is a perspective view of the anvil shown in FIG. 1 and a crimper associated with the anvil.

As shown in FIGS. 1 to 3, an anvil (die) 10 according to a first embodiment of the present invention is one of various components which, together with a crimper (mating die) 20, constitute a press apparatus, not shown, and crimps a contact 30 (see FIGS. 4 to 6) on an electric wire 40 in cooperation with the crimper 20 to thereby fir the contact 30 on the electric wire 40.

The crimper 20 includes a plate-shaped main body 21 and a pair of press-bending portions 22 which protrude downward from a lower surface of the main body 21. The main body 21 is formed with a screw insertion hole 211. A receiving space 23 for receiving a protruding portion 12 of the anvil 10 is formed between the pair of press-bending portions 22.

The anvil 10 includes a base portion 11, the protruding portion 12, and a wall portion 13. The base portion 11 is plate-shaped. A two-dot chain line TL in FIG. 1 indicates a boundary between the base portion 11 and the wall portion 13. The base portion 11, the protruding portion 12, and the wall portion 13 are integrally formed. As a material for the anvil 10, there may be mentioned a tool steel, for example.

The protruding portion 12 is located in the central portion of an tipper surface 111 of the base portion 11. The protruding portion 12 protrudes upward from the base portion 11. The protruding portion 12 is a portion for supporting a core wire-fixing portion 32 (see FIGS. 4 and 5) of the contact 30 when fixing the contact 30 on the electric wire 40, and has a shape which becomes thinner as it extends upward. An upper surface 121 of the protruding portion 12 is formed with a dent 122. The dent 122 has a columnar surface-like shape which extends in a front-rear direction BF of the protruding portion 12. The protruding portion 12 is inserted into the receiving space 23 of the crimper 20 when the protruding portion 13 crimps the core wire-fixing portion 32 of the contact 30 in cooperation with the crimper 20 (see FIG. 3). The protruding portion 12 has a dimension in the front-rear direction BF which is equal to a dimension of the base portion 11 in the front-rear direction BF. Note that as shewn in FIGS. 4 and 5, the contact 30 includes the core wire-fixing portion 32, a contact portion 33, and a linking portion 31 linking the core wire-fixing portion 32 and the contact portion 33. The contact portion 33 includes a pair of contact piece portions 331 and a base portion 332 which connects the pair of contact piece portions 331. A plurality of the contacts 30 are connected to a same carrier 35 via supporting arm portions 351, respectively.

The wall portion 13 is plate-shaped, and is connected to respective rear surfaces of the base portion 11 and the protruding portion 12. The base portion 11 is formed with two screw insertion holes 112, and these screw insertion holes 112 each penetrate through the base portion 11 and the wall portion 13. The wall portion 13 has a dimension in a left-right direction LR of the protruding portion 12 which is equal to a dimension of the base portion 11 in the left-right direction LR. A dimension from a bottom surface 136 of the wall portion 13 to a flat surface 131 of the same in a vertical direction UD of the base portion 11 is slightly smaller than a dimension from a botton portion 113 of the base portion 11 to the upper surface 121 of the protruding portion 12 in the vertical direction UD. The wall 13 extends further upward than the base portion 11, and extends further leftward and rightward than the protruding portion 12.

The wall portion 13 includes the flat surface 131, first inclined surfaces (inclined surfaces) 132, second inclined surfaces 133, horizontal surfaces 134, side surfaces 13S, and the bottom surface 136.

The flat surface 131 is formed is the central portion of the upper part of the wall portion 13. The flat surface 131 is located at a level lower than the upper surface 121 of the protruding portion 12 in the vertical direction UD, and is located rearward of the upper surface 121 in the front-rear direction BF. Further, the flat surface 131 is at the sasae level as the lowest portion of the dent 122 in the vertical direction UD. A rear end of the flat surface 131 in the front-rear direction BF is formed with a cutting blade 131A for cutting a supporting ana portion 351 of the carrier 35, which supports the contact 30 associated therewith. A dissension L2 of the flat surface 131 of the wall portion 13 in the left-right direction LR is larger than a dimension L1 of the upper surface 121 of the protruding portion 12 in the left-right direction LR (see FIG. 2).

The first inclined surfaces 132 extend in opposite directions from opposite ends of the flat surface 131 in the left-right direction LR, respectively, such that they are inclined downward as they extend away from the flat surface 131 in the left-right direction LR. One end of each first inclined surface 132 is continuant with an end of the fiat surface 131 in the left-right direction LR, and the other end of each first inclined surface 132 is continuous with one end of an associated one of the horizontal surfaces 134 in the left-right direction LR. The horizontal surfaces 134 each extend in parallel with the left-right direction LR. The second inclined surfaces 133 are inclined downward as they extend away from the respective other ends of the horizontal surfaces 134 in the left-right direction LR. One end of each second inclined surface 133 is continuous with the other end of an associated one of the horizontal surfaces 134, and the other end of each second inclined surface 133 is continuous with one end of an associated one of the side surfaces 135.

Next, a description will be given of an operation for fixing the contact 30 on the electric wire 40 using the press apparatus including the anvil 10 and the crimper 20 shown in FIG. 3.

Before performing the operation for fixing the contact 30 on the electric wire 40, the following preparation is performed.

The anvil 10 is screwed to an anvil block (not shown) which is screwed to a base plate (not shown) of the press apparatus, and the crimper 20 is screwed to a crimper holder (not shown) supported by an applicator body (not shown) on the base plate in a vertically movable manner.

Figure 4:
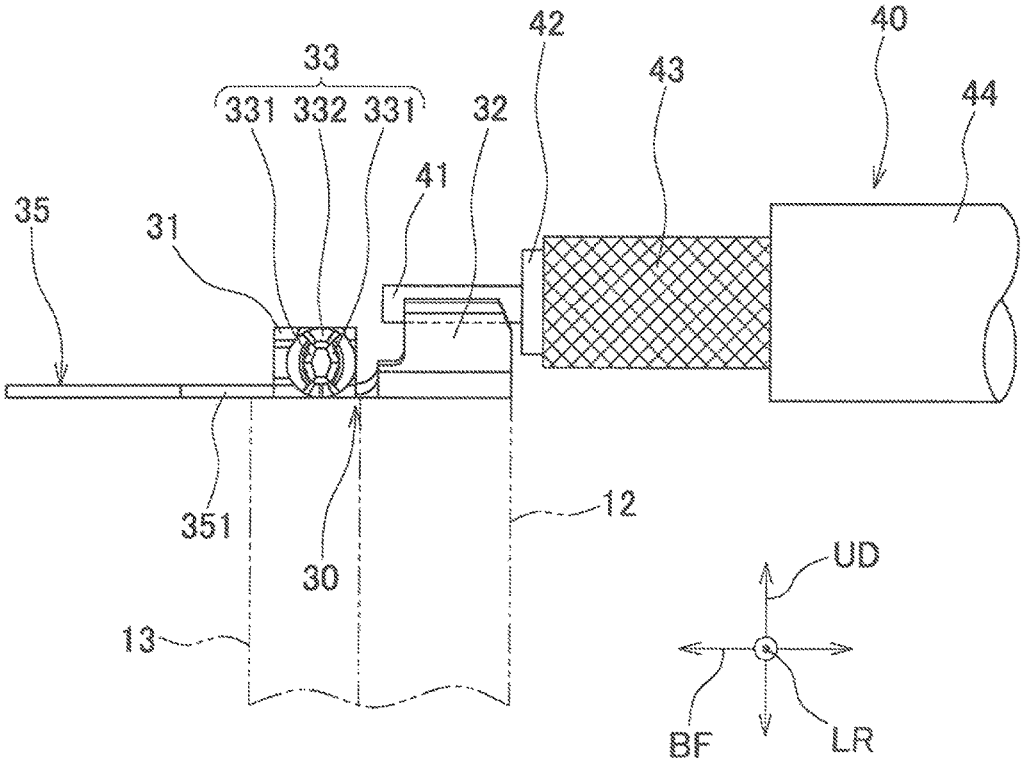
FIG. 4 is a side view of an electric wire and a contact in a state before a core wire-fixing portion of the contact is fixed on a core wire of the electric wire.

Further, as shown in FIG. 4, one end portion of an outer cover 44 of the electric wire 40 is removed to thereby expose a shield braid 43, and one end portion of the shield braid 43 is removed to thereby expose an inner cover 42. Further, one end portion of the inner cover 42 is removed to thereby expose one end portion of a core wire 41. The contacts 30 connected to the carries 35 are set on a contact feeding mechanism (not shown) disposed near the base plate.

After completion of the above-described preparation, the operation for fixing the contact 30 on the electric wire 40 is performed by the press apparatus including the anvil 10 and the crimper 20.

First, the core wire-fixing portion 32 of one contact 30 out of the plurality of the contacts 30 connected to the carrier 35 is fed in the left-right direction LR by the contact feeding mechanism onto the upper surface 121 of the protruding portion 12 of the anvil 10. At this time, the contact 30 is guided onto the horizontal surface 134 by the second inclined surface 133 of the anvil 10. After that, the contact 30 is moved on the horizontal surface 134, and is guided onto the flat surface 131 by the first inclined surface 132. As a result, the linking portion 31 of the contact 30 is arranged on the flat surface 131, and the core wire-fixing portion 32 of the contact 30 is received in the dent 122 of the upper surface 121 of the protruding portion 12.

Figure 5:
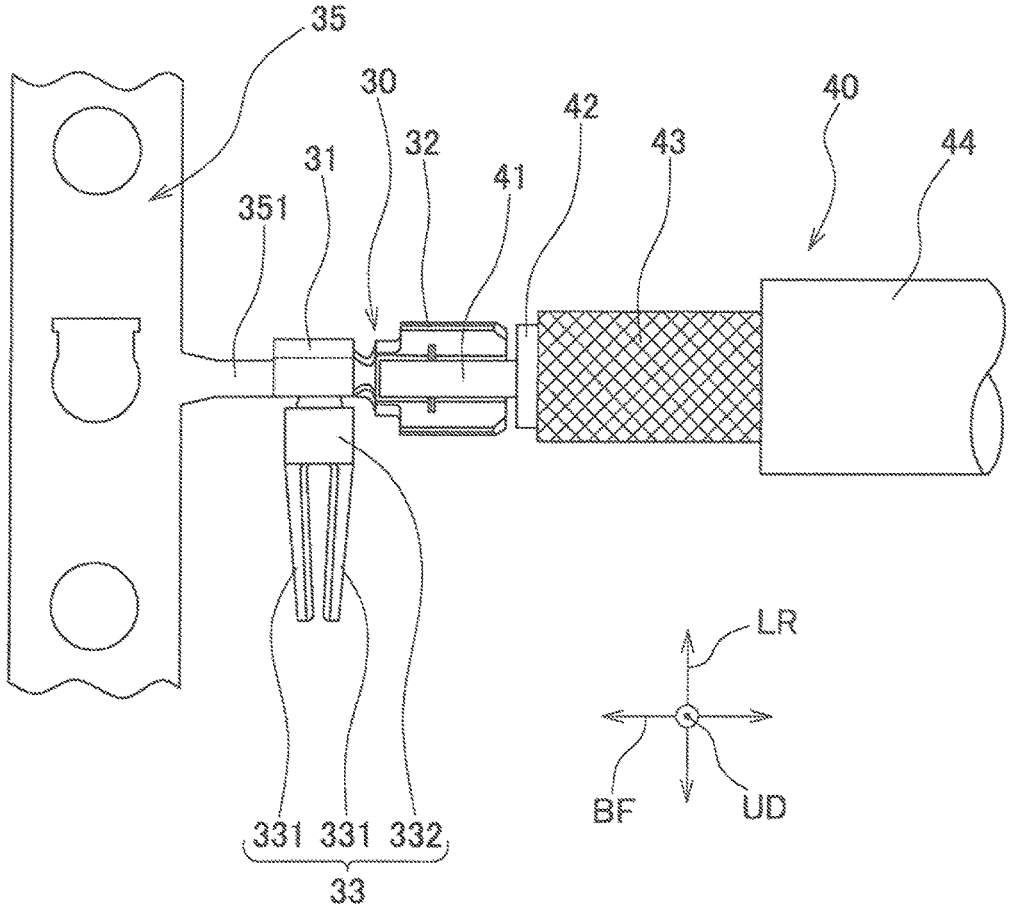
FIG. 5 is a plan view of the electric wire and the contact shown in FIG. 4.

Although the anvil 10 is omitted in FIG. 5, FIG. 4 shows a state in which the core wire-fixing portion 32 of the contact 30 is supported in the dent 122 of the upper surface 121 of the protruding portion 12, and the linking portion 31 of the contact 30 is supported on the flat surface 131 of the wall portion 13. Further, part of the carrier 35 and one of the supporting arm portions 351 of the carrier 35 are received in a groove formed in a movable cutter, not shown, which is mounted on the anvil block of the press apparatus.

Next, the core wire 41 of the electric wire 40 is arranged in the core wire-fixing portion 32 of the contact 30 by a manual operation.

Figure 6:
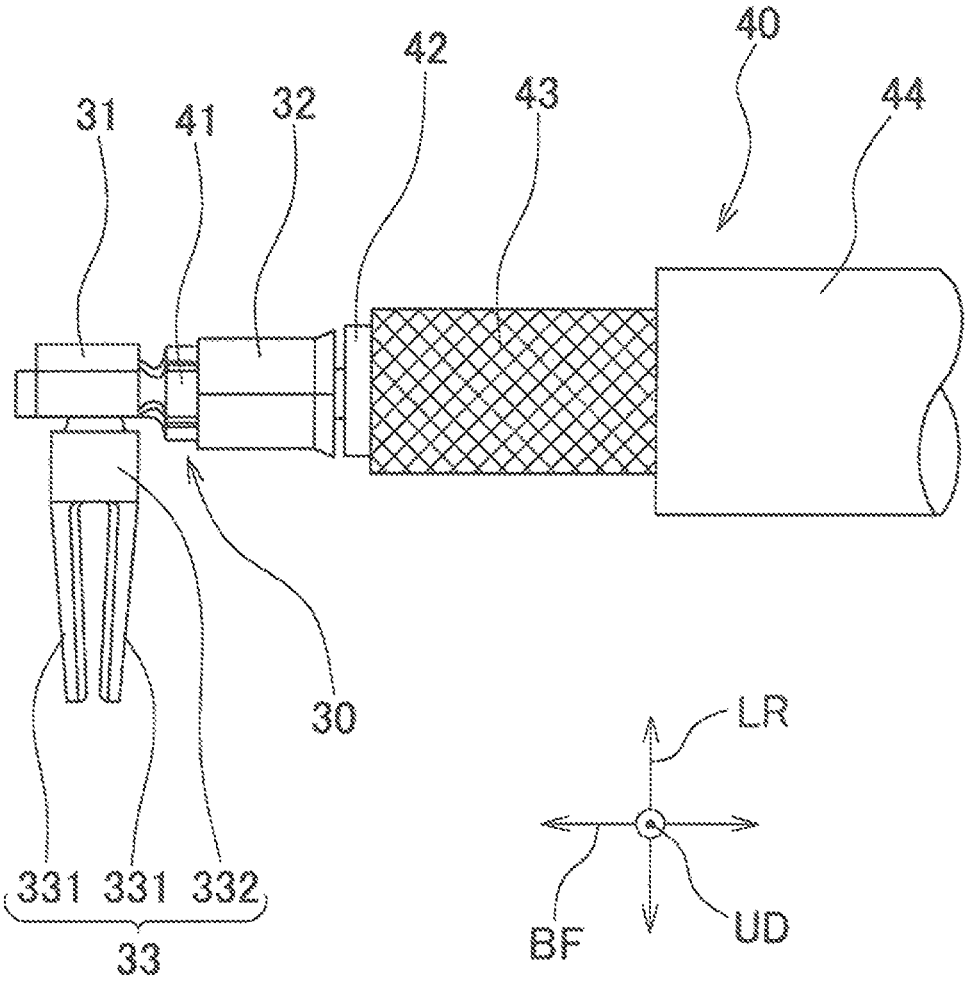
FIG. 6 is a plan view of the electric wire and the contact shown in FIG. 4 in a state in which the core wire-fixing portion of the contact has been fixed on the core wire of the electric wire.

Then, the crimper holder is lowered. As a result, the core wire-fixing portion 32 of the contact 30 is crimped into a beat shape by the press-bending portions 22 of the crimper 20, and as shown in FIG. 6, and the core wire-fixing portion 32 of the contact 30 embraces the core wire 41 of the electric wire 40, whereby the core wire-fixing portion 32 is fixed on the core wire 41. At this time, although the protruding portion 12 of the anvil 10 receives the force from the crimper 20 via the core wire-fixing portion 32 of the contact 30, the protruding portion 12 has a rigidity in the left-right direction LR which has been increased by the wall portion 13, and hence the protruding portion 12 is hardly tilted in the left-right direction LR. Therefore, the protruding portion 12 of the anvil 10 hardly slides on the press-bending portions 22 of the crimper 20 due to the tilt thereof in the left-right direction LR.

Further, when the crimper holder is lowered, the movable cutter is pushed down by the crimper holder, and the supporting arm portion 351 of the carrier 35 is cut by a cutting blade (not shown) of the movable cutter and the cutting blade 131A of the wall portion 13. Then, the crimper holder is lifted up, and the electric wire 40 on which the contact 30 has been fixed is taken out from the press apparatus.

Thus, the operation for fixing the contact 30 on the electric wire 40 is performed.

According to the present embodiment, the rigidity of the protruding portion 12 in the left-right direction LR is increased by the wall portion 13 of the anvil 10, and hence even when the number of times of use of the anvil 10 increases, the protruding portion 12 is hardly plastically deformed in the left-right direction LR, whereby it is possible to extend the service life of the anvil 10. Further, it is possible to suppress deformation and breakage of the crimper 20.

Further, since the protruding portion 12 and the press-bending portions 22 of the crimper 20 hardly slide on each other, inner wall surfaces of the press-bending portions 22, on which mirror finish is made, is prevented from becoming rough. As a result, generation of metallic dust caused by shaving the core-wire-fixing portion 32 of the contact 30 is suppressed, and hence it is possible to reduce connection failure of the contact 30 caused by adhesion of metallic dust to the core-wire-fixing portion 32 of the contact 30, and suppress metallic dust between the press-bending portions 22 of the crimper 20 and the contact 30 from functioning as polishing agent to wear the inner wall surface of the press-bending portions 22 of the crimper 20.

Further, since the rear end of the flat surface 131 of the wail portion 13 oil the anvil 10 is formed with the cutting blade 131A, the need of a fired cutter as a dedicated component of the press apparatus is eliminated, and it is possible to reduce the number of components of the press apparatus.

Further, since the dimension L2 of the flat surface 131 of the wall portion 13 in the left-right direction LR is larger than the dimension L1 of the upper surface 121 of the protruding portion 12 in the left-right, direction LR, it is possible to cut the supporting arm portion 351 which, is larger in dimension in the left-right direction LR.

Further, when the contact 30 is fed onto the upper surface 121 of the protruding portion 12 by the contact feeding mechanism, the contact 30 is guided by the first inclined surface 132, and is slid onto the flat surface 131, and hence the core wire-fixing portion 32 of the contact 30 is smoothly received into the dent 122 of the upper surface 121 of the protruding portion 12, which suppresses damage to the contact 30 and the protruding portion 12.

Next, a description will be given of an anvil (die) according to a second embodiment of the present invention with reference to FIG. 7. The same components as those of the anvil according to the first embodiment are denoted by the same reference numerals, and detailed description thereof is omitted. The following description will be given of only different components from those of the anvil according to the first embodiment.

Figure 7:
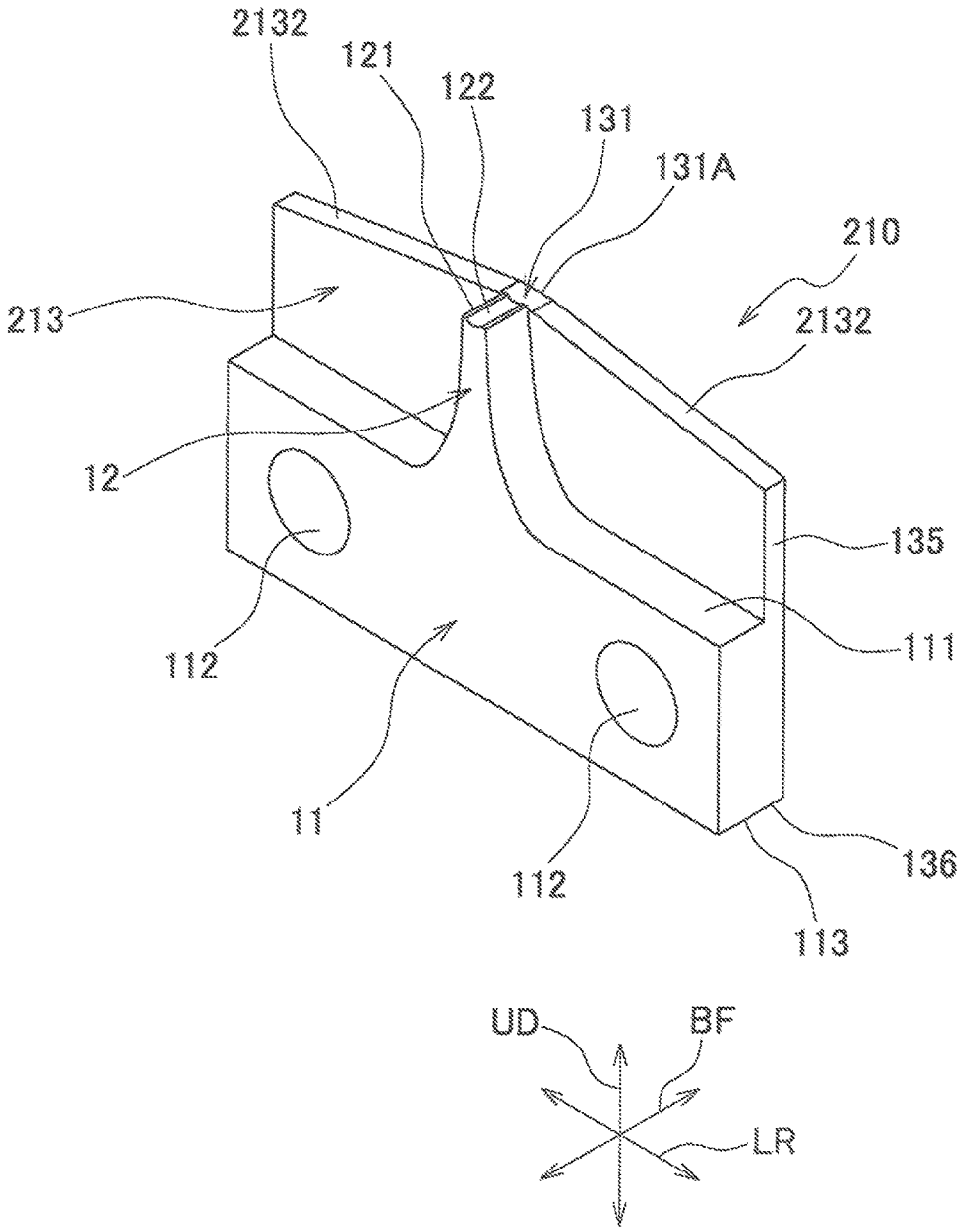
FIG. 7 is a perspective view of an anvil according to a second embodiment of the present invention.
Figure 8:
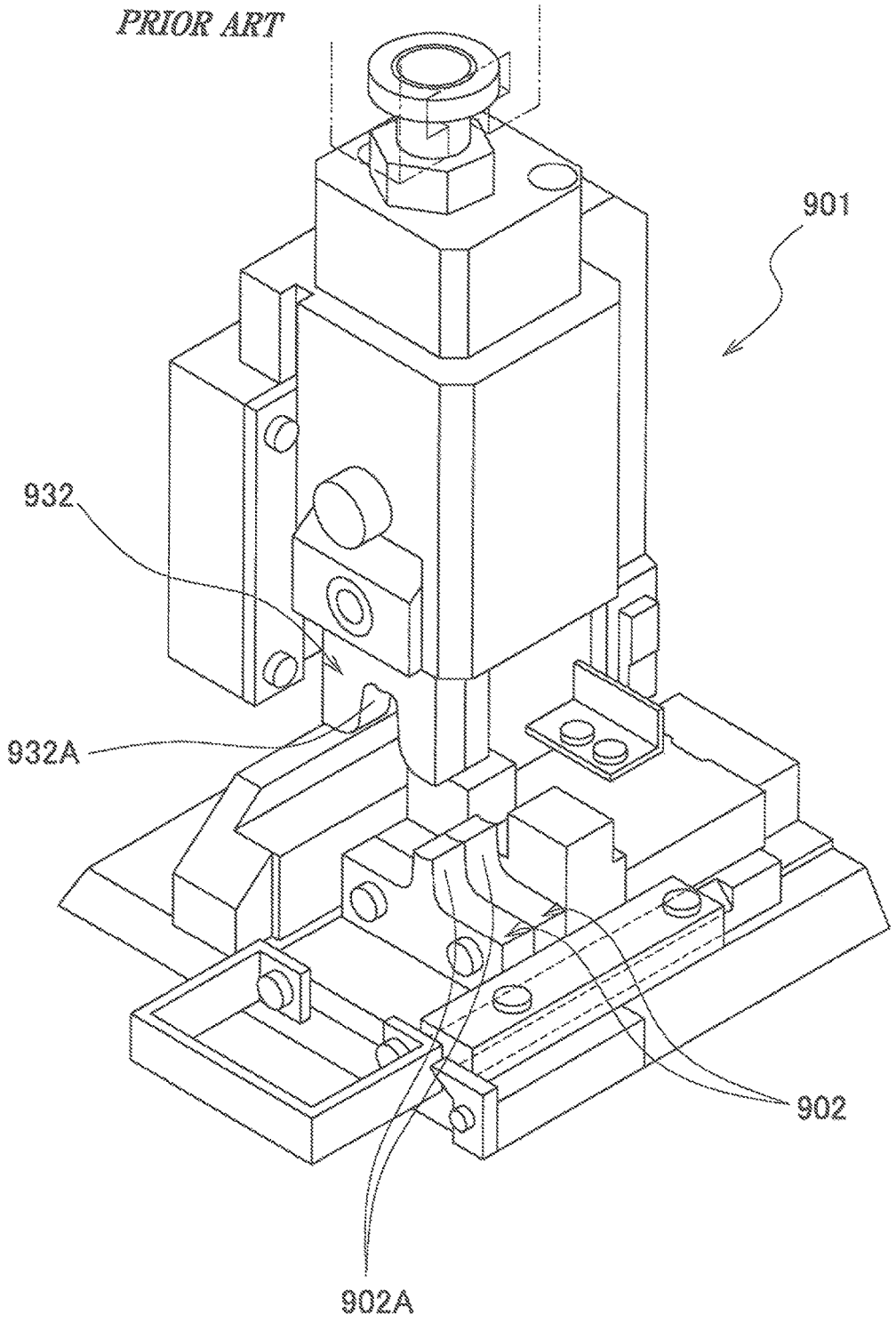
FIG. 8 PRIOR ART
FIG. 8 is a perspective view of a conventional terminal crimping machine.
Figure 9:
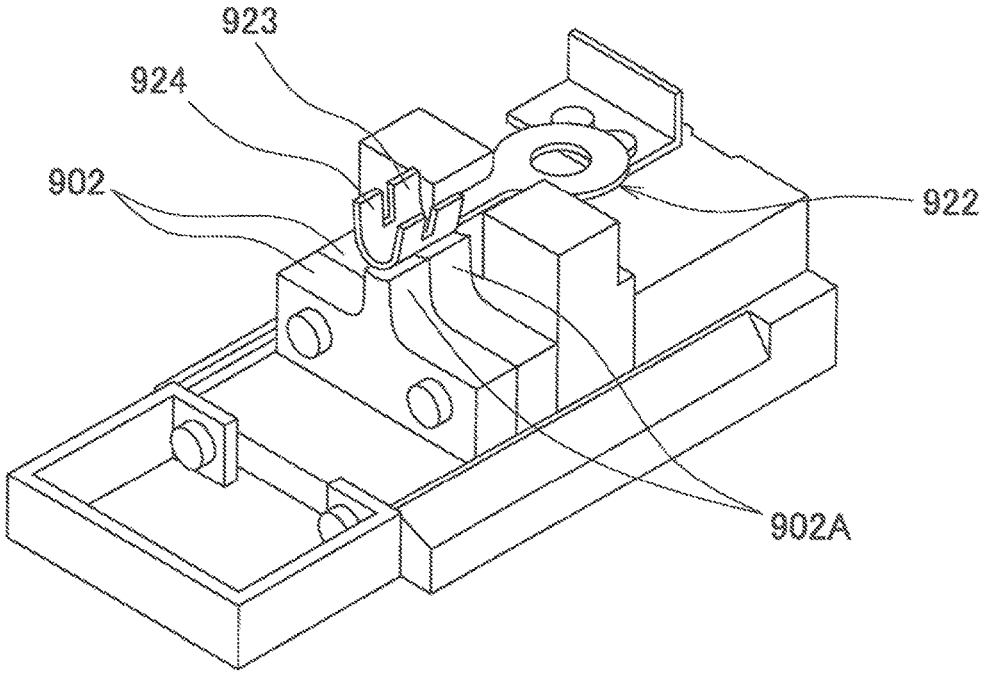
FIG. 9 PRIOR ART
FIG. 9 is a perspective view of a state in which a conductor crimping piece portion and a sheath crimping piece portion of a terminal are supported on respective upper surfaces of protruding portions of anvils.

As shown in FIG. 7, in the anvil, denoted by reference numeral 210, according to the second embodiment, inclined surfaces 2132 of a wall portion 213 extend in opposite directions from opposite ends of the flat surface 131, such that they are inclined downward as they extend away from the flat surface 131 in the left-right direction LR, and reach the respective upper ends of the side surfaces 135.

The inclined surfaces 2132 guide the contact 30 fed to the anvil 210 by the contact feeding mechanise onto the flat surface 131.

According to the second embodiment, it is possible to obtain the same advantageous effects as provided by the first embodiment.

Note that the dimension L2 of the flat surface 131 of the wall portion 13 in the left-right direction LR is not necessarily required to be larger than the dimension L1 of the upper surface 121 of the protruding portion 12 in the left-right direction LR.

Further, although in the first and second embodiments, the wall portions 13 and 213 are connected only to the rear surfaces of the base portion 11 and the protruding portion 12, the wall portions 13 and 213 may be connected only to the front surfaces of the base portion 11 and the protruding portion 12, or may be connected to both of the front surfaces and the rear surfaces of the base portion 11 and the protruding portion 12.

Although in the first and second embodiments, the wall portions 13 and 213 extend leftward and rightward from the protruding portion 12, the wall portions 13 and 213 may extend only leftward from the protruding portion 12, or only rightward from the protruding portion 12.

Further, the wall portions 13 and 213 may be formed with a through hole or a slit, not shown, insofar as the rigidity of the wall portions 13 and 213 is not largely reduced.

It is further understood by those skilled in the art that the foregoing are the preferred embodiments of the present invention, and that various changes and modification may be made thereto without departing from the spirit and scope thereof.

What is claimed is:

1. A die that crimps a contact in cooperation with a mating die to thereby fix the contact on an electric wire, comprising:

a base portion;

a protruding portion that is formed on said base portion in a manner protruding upward from said base portion, and can be inserted in a receiving space of the mating die; and a wall portion that is connected to front surfaces or rear surfaces of said base portion and said protruding portion, wherein said wall portion extends further upward than said base portion, and extends further in at least one of leftward and rightward directions than said protruding portion, wherein an upper surface of said protruding portion, which is configured to support the contact, is formed with a dent having an upper portion and a lower portion, wherein said wall portion is formed with a flat surface that is located at a level lower than the upper portion of said dent and at a same level as the lower portion of said dent, the flat surface being adjacent to the upper surface in a front-rear direction of said protruding portion, and wherein one end of the flat surface in the front-rear direction is formed with a cutting blade for cutting a supporting arm portion of a carrier that supports the contact.

2. The die according to claim 1, wherein said wall portion is plate-shaped.

3. The die according to claim 2, wherein a dimension of the flat surface of said wall portion in a left-right direction of said protruding portion is larger than a dimension of the upper surface of said protruding portion in the left-right direction.

4. The die according to claim 3, wherein said wall portion has inclined surfaces formed in a manner continuous with the flat surface such that the inclined surfaces are inclined downward from the flat surface as the inclined surfaces extend away from the flat surface in the left-right direction.

5. The die according to claim 2, wherein said wall portion has inclined surfaces formed in a manner continuous with the flat surface such that the inclined surfaces are inclined downward from the flat surface as the inclined surfaces extend away from the flat surface in a left-right direction of said protruding portion.

6. The die according to claim 1, wherein a dimension of the flat surface of said wall portion in a left-right direction of said protruding portion is larger than a dimension of the upper surface of said protruding portion in the left-right direction.

7. The die according to claim 6, wherein said wall portion has inclined surfaces formed in a manner continuous with the flat surface such that the inclined surfaces are inclined downward from the flat surface as the inclined surfaces extend away from the flat surface in the left-right direction.

8. The die according to claim 1, wherein said wall portion has inclined surfaces formed in a manner continuous with the flat surface such that the inclined surfaces are inclined downward from the flat surface as the inclined surfaces extend away from the flat surface in a left-right direction of said protruding portion.

9. A press apparatus including a die that crimps a contact in cooperation with a mating die to thereby fix the contact on an electric wire, the die comprising:

a base portion;

a protruding portion that is formed on said base portion in a manner protruding upward from said base portion, and can be inserted in a receiving space of the mating die; and a wall portion that is connected to front surfaces or rear surfaces of said base portion and said protruding portion, wherein said wall portion extends further upward than said base portion, and extends further in at least one of leftward and rightward directions than said protruding portion, wherein an upper surface of said protruding portion, which is configured to support the contact, is formed with a dent having an upper portion and a lower portion, wherein said wall portion is formed with a flat surface that is located at a level lower than the upper portion of said dent and at a same level as the lower portion of said dent, the flat surface being adjacent to the upper surface in a front-rear direction of said protruding portion, and wherein one end of the flat surface in the front-rear direction is formed with a cutting blade for cutting a supporting arm portion of a carrier that supports the contact.

10. the press apparatus according to claim 9, wherein said wall portion is plate-shaped.

* * * * *